US010741122B2

(12) United States Patent
Pyeon

(10) Patent No.: US 10,741,122 B2
(45) Date of Patent: Aug. 11, 2020

(54) ORGANIC LIGHT EMITTING DISPLAY DEVICE AND CONTROL METHOD THEREOF

(71) Applicant: LG DISPLAY CO., LTD., Seoul (KR)

(72) Inventor: Myung Jin Pyeon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 42 days.

(21) Appl. No.: 15/717,425

(22) Filed: Sep. 27, 2017

(65) Prior Publication Data

US 2018/0096650 A1 Apr. 5, 2018

(30) Foreign Application Priority Data

Sep. 30, 2016 (KR) ..... 10-2016-0126509

(51) Int. Cl.
*G09G 3/3233* (2016.01)
*G09G 3/3291* (2016.01)
*G09G 3/3266* (2016.01)

(52) U.S. Cl.
CPC ..... *G09G 3/3233* (2013.01); *G09G 3/3266* (2013.01); *G09G 3/3291* (2013.01); *G09G 2310/0232* (2013.01); *G09G 2310/066* (2013.01); *G09G 2310/08* (2013.01); *G09G 2320/0209* (2013.01); *G09G 2320/0219* (2013.01); *G09G 2320/0233* (2013.01); *G09G 2320/0295* (2013.01); *G09G 2320/041* (2013.01); *G09G 2320/0673* (2013.01)

(58) Field of Classification Search
CPC ..... G09G 3/32; G09G 3/3233; G09G 3/3291; G09G 3/3266
See application file for complete search history.

(56) References Cited

U.S. PATENT DOCUMENTS 5,684,503 A * 11/1997 Nomura ..... G09G 3/3629 345/94
5,903,251 A * 5/1999 Mori ..... G09G 3/3629 345/101
6,037,920 A * 3/2000 Mizutome ..... G09G 3/3629 345/101
2009/0315918 A1* 12/2009 Minami ..... G09G 3/3233 345/690
2012/0212463 A1* 8/2012 Yokoyama ..... G09G 3/3677 345/204

FOREIGN PATENT DOCUMENTS

CN 104637443 A 5/2015

* cited by examiner

*Primary Examiner* — Alexander Eisen
*Assistant Examiner* — Cory A Almeida
(74) *Attorney, Agent, or Firm* — Seed IP Law Group LLP

(57) ABSTRACT

The present disclosure provides an organic light emitting display device including a display panel in which a plurality of Sub Pixels defined by a plurality of Data Lines and a plurality of Gate Lines are arranged, and a control method thereof. The organic light emitting display device includes a temperature sensor configured to detect a temperature of the display panel, and a gate pulse modulator configured to modulate a voltage in a falling section of a scan signal provided to the plurality of GLs, in real time in accordance with the temperature. Accordingly, it is possible to prevent data from being mixed with each other, so that a clearer image can be realized, thereby improving the image quality.

17 Claims, 8 Drawing Sheets

ORGANIC LIGHT EMITTING DISPLAY DEVICE AND CONTROL METHOD THEREOF

CROSS REFERENCE TO RELATED APPLICATION

This application claims priority from Korean Patent Application No. 10-2016-0126509, filed on Sep. 30, 2016, which is hereby incorporated by reference for all purposes as if fully set forth herein.

BACKGROUND DISCLOSURE

Technical Field

The present disclosure relates to an organic light emitting display device and a control method thereof.

Description of the Related Art

In recent years, an organic light emitting display device that has been spotlighted as a display device has advantages of having a high response speed, excellent light emitting efficiency, an excellent luminance, a large viewing angle, etc., by using an Organic Light Emitting Diode (OLED) that emits light by itself.

In a display panel of such an organic light emitting display device, a plurality of Data Lines (DLs) and a plurality of Gate Lines (GLs) are arranged to define a plurality of Sub Pixels (SPs) and a circuit element such as a transistor is arranged for each SP region. Such SPs are supplied with a data voltage from one DL, and supplied with one or more scan signals from one or more GLs.

Meanwhile, the scan signal is formed of a square wave. The scan signal has a phenomenon in which a luminance is lowered at both ends of the display panel due to a kickback phenomenon of a parasitic capacitor and an RC structure. In order to prevent this, a scan signal waveform in both end regions of the display panel is modulated such that voltages flowing in the SPs at both end regions and central region of the display panel are made equal.

When the scan signal waveform is modulated and the display panel is heated to a high temperature, a fall time of the scan signal is increased and a data signal becomes longer by the increased fall time. Accordingly, not only data applied to the corresponding DL but also a part of data to be applied to the next DL are applied together, so that the data is mixed and lattice-like stains are generated in the display panel.

BRIEF SUMMARY

With this background, an aspect(s) of the present disclosure is to provide an organic light emitting display device that can reduce a fall time of a scan signal when a display panel is at a high temperature, and a control method thereof.

An aspect of the present disclosure provides an organic light emitting display device including a display panel in which a plurality of Sub Pixels (SPs) defined by a plurality of Data Lines (DLs) and a plurality of Gate Lines (GLs) are arranged. The display device includes a temperature sensor configured to detect a temperature of the display panel. Also, the display device includes a gate pulse modulator configured to modulate a voltage in a falling section of a scan signal provided to the plurality of GLs, in real time in accordance with the temperature. Also, the display device includes a timing controller configured to receive information on the temperature detected by the temperature sensor, and provide information on a correction voltage of the scan signal corresponding to the temperature to the gate pulse modulator.

Another aspect of the present disclosure provides a control method of an organic light emitting display device including a display panel in which a plurality of SPs defined by a plurality of DLs and a plurality of GLs are arranged. The control method includes detecting a temperature of the display panel. Also, the control method includes modulating a voltage in a falling section of a scan signal provided to the plurality of GLs, in real time in accordance with the temperature.

As described above, according to the present embodiments, it is possible to prevent the fall time of the scan signal from being increased by variably modulating the correction voltage of the scan signal according to the temperature of the display panel. Accordingly, data may be prevented from being mixed with each other, so that a clearer image may be realized, thereby improving the image quality.

BRIEF DESCRIPTION OF THE SEVERAL VIEWS OF THE DRAWINGS

The above and other objects, features and advantages of the present disclosure will be more apparent from the following detailed description taken in conjunction with the accompanying drawings, in which.

DETAILED DESCRIPTION OF THE EXAMPLE EMBODIMENTS

Figure 1:
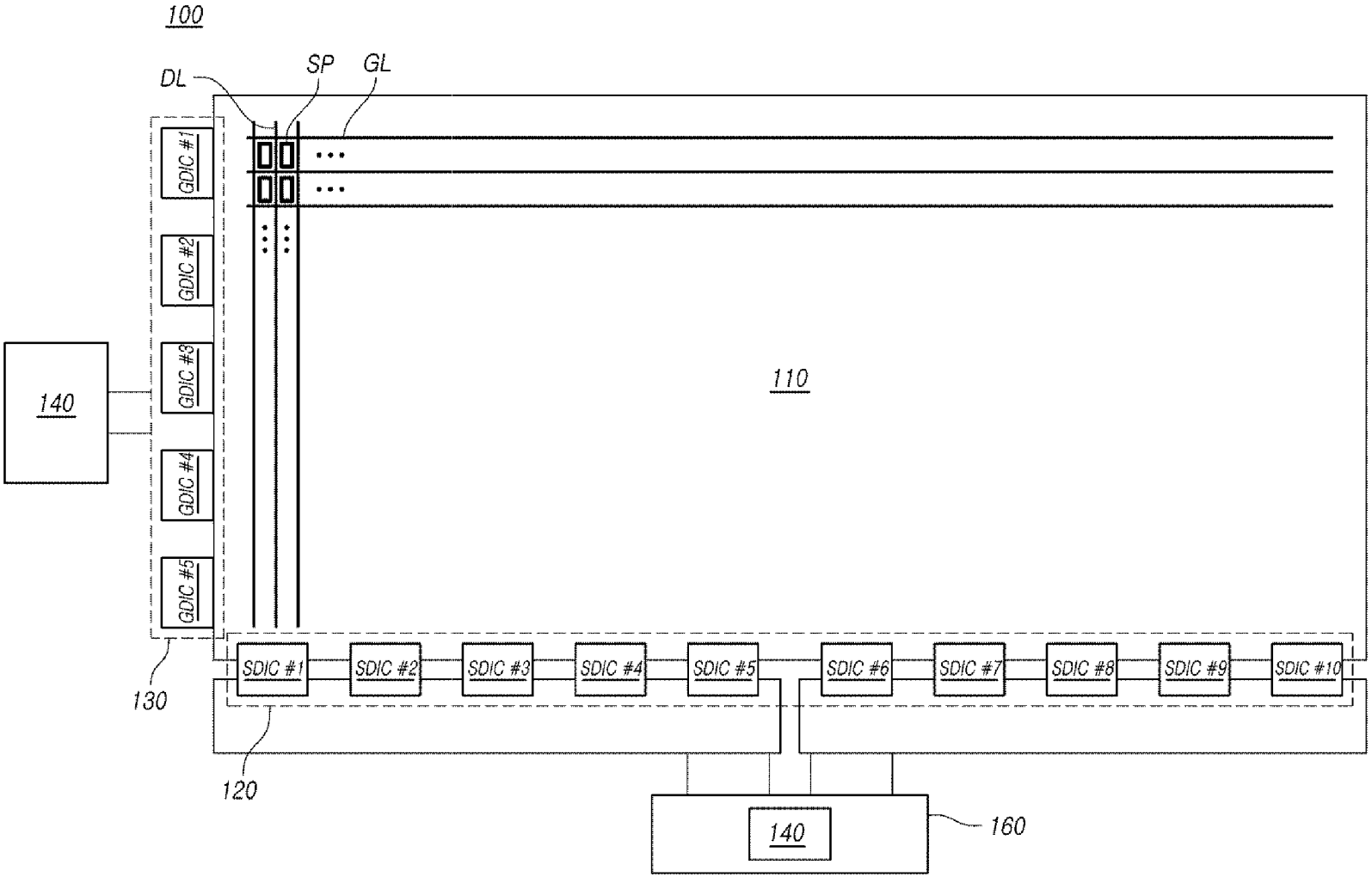
FIG. 1 is a schematic system configuration diagram of an organic light emitting display device according to embodiments of the present disclosure.

Hereinafter, embodiments of the present disclosure will be described in detail with reference to the accompanying drawings. The following embodiments are provided, by way of example, so that the idea of the present disclosure can be sufficiently transferred to those skilled in the art. Therefore, the present disclosure is not limited to the embodiments as described below, and may be embodied in other forms. Also, in the drawings, the size, thickness, and the like of a device may be exaggeratedly represented for the convenience of description. Throughout the specification, the same reference numerals designate the same elements.

The advantages and features of the present disclosure and methods of achieving the same will be apparent by referring to embodiments of the present disclosure as described below in detail in conjunction with the accompanying drawings. However, the present disclosure is not limited to the embodiments set forth below, but may be implemented in various different forms. The following embodiments are provided only to completely disclose the present disclosure and inform those skilled in the art of the scope of the present disclosure, and the present disclosure is defined only by the scope of the appended claims. Throughout the specification, the same or like reference numerals designate the same or like elements. In the drawings, the dimensions and relative sizes of layers and regions may be exaggerated for the convenience of description.

When an element or layer is referred to as being "above" or "on" another element, it can be "directly above" or "directly on" the other element or layer or intervening elements or layers may be present. In contrast, when an element is referred to as being "directly on" or "directly above" another element or layer, there are no intervening elements or layers present.

Spatially relative terms, such as "below," "beneath," "lower," "above," "upper" and the like, may be used herein for ease of description to describe one element or feature's relationship to another element(s) or feature(s) as illustrated in the figures. It will be understood that the spatially relative terms are intended to encompass different orientations of the element in use or operation in addition to the orientation depicted in the figures. For example, if the element in the figures is turned over, elements described as "below" or "beneath" other elements would then be oriented "above" the other elements. Thus, the example term "below" can encompass both an orientation of above and below.

In addition, terms, such as first, second, A, B, (a), (b) or the like may be used herein when describing components of the present disclosure. Each of these terminologies is not used to define an essence, order or sequence of a corresponding component but used merely to distinguish the corresponding component from other component(s).

FIG. 1 is a schematic system configuration diagram of an organic light emitting display device according to embodiments of the present disclosure.

Referring to FIG. 1, an organic light emitting display device 100 according to embodiments of the present disclosure includes a display panel 110 in which a plurality of Data Lines (DLs) DL1 to DLm and a plurality of Gate Lines (GLs) GL1 to GLn are arranged and a plurality of Sub Pixels (SPs) are arranged, a source driver 120 that is connected to, e.g., at least one of an upper or lower end of the display panel 110 to drive the plurality of DLs (DL1 to DLm), a gate driver 130 that drives the plurality of GLs (GL1 to GLn), and a timing controller 140 that controls the source driver 120 and the gate driver 130 and adjusts a correction voltage of a scan signal provided to the gate driver 130 according to a temperature of the display panel 110.

Referring to FIG. 1, in the display panel 110, the plurality of SPs are arranged in a matrix type.

The source driver 120 drives the plurality of DLs (DL1 to DLm) by supplying a data voltage to the plurality of DLs (DL1 to DLm).

The gate driver 130 sequentially supplies scan signals to the plurality of GLs (GL1 to GLn) under a control of the timing controller 140 to sequentially drive the plurality of GLs (GL1 to GLn). Here, the gate driver 130 is also referred to as a scan driver.

Depending on a driving method or a panel designing method, the gate driver 130 may be located only on one side of the display panel 110 as shown in FIG. 1, or located on both sides thereof, if necessary. In addition, the gate driver 130 may include one or more Gate Driver Integrated Circuits (GDICs) (shown as five for illustrative purposes only).

When a Gate Line GL is opened by a specific scan signal, the source driver 120 converts image data received from the timing controller 140 into an analog-type data voltage (Vdata) and supplies the Vdata to the plurality of DLs (DL1 to DLm), thereby driving the plurality of DLs (DL1 to DLm).

The source driver 120 may drive the plurality of DLs through the included one or more Source Driver Integrated Circuits (SDICs) (shown as ten for illustrative purposes only).

The above-described GDIC or SDIC may be connected to a bonding pad of the display panel 110 by a Tape Automated Bonding (TAB) method, attached directly on the display panel 110 through a Chip On Glass (COG) method, or integrated with the display panel 110 and arranged, if necessary.

Each SDIC may include a logic unit having a shift register, a latch circuit, etc., a Digital Analog Converter (DAC), an output buffer, an Analog Digital Converter (ADC) and the like.

Meanwhile, in the organic light emitting display device 100 according to the present embodiments, each of the SPs includes an Organic Light Emitting Diode (OLED) and a circuit element such as a transistor for driving the OLED. The types and the number of the circuit elements constituting the respective SPs may be variously determined depending on a providing function, a design method, and the like.

Figure 2:
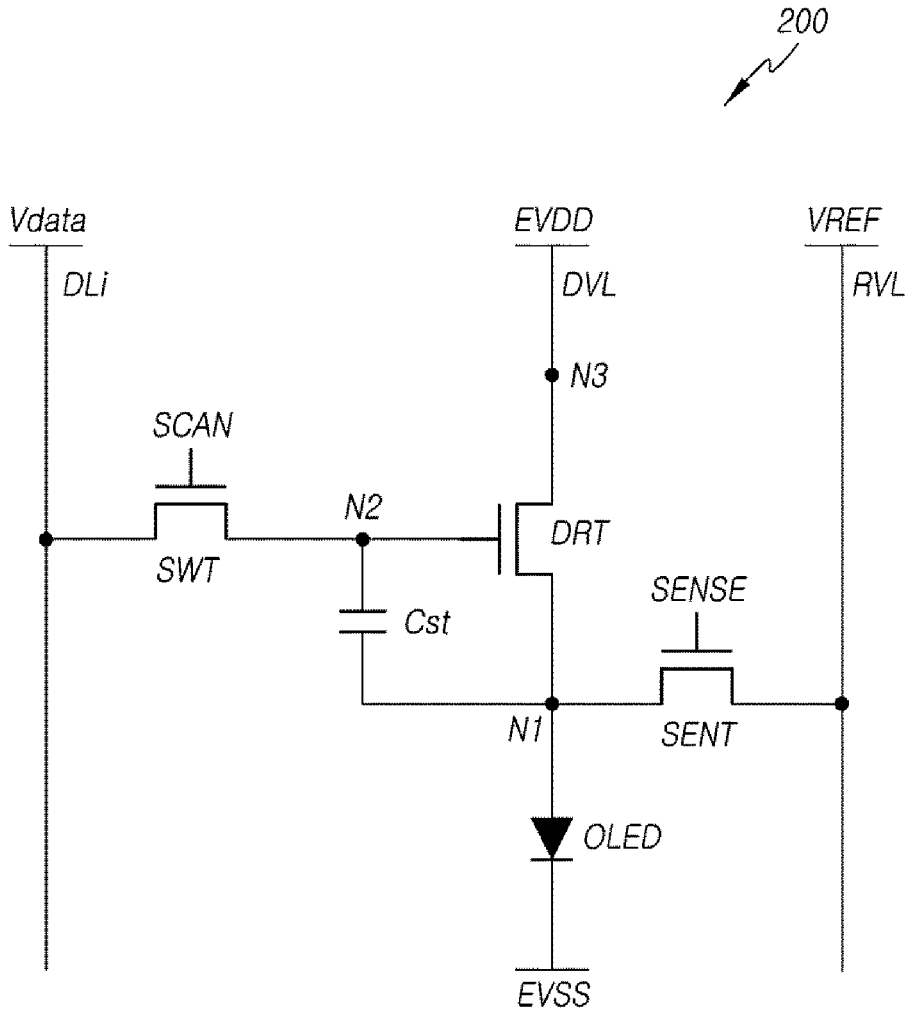
FIG. 2 is a diagram illustrating a Sub Pixel (SP) circuit of an organic light emitting display device according to embodiments of the present disclosure.

FIG. 2 is a diagram illustrating a Sub Pixel (SP) circuit of an organic light emitting display device 100 according to embodiments of the present disclosure.

The SP 200 of FIG. 2 is an arbitrary SP supplied with a data voltage (Vdata) from an ith DL (DLi, i=1–m).

Referring to FIG. 2, the SP circuit 200 may include a Driving Transistor (DRT), a Switching Transistor (SWT), a Sensing Transistor (SENT), and a Storage Capacitor (Cst).

The DRT may drive an OLED by supplying a driving current (and/or driving voltage) to the OLED, and be connected between the OLED and a Driving Voltage Line (DVL) for supplying a driving voltage (EVDD). The DRT has a first node N1 corresponding to a source node or a drain node, a second node N2 corresponding to a gate node, and a third node N3 corresponding to a drain node or a source node.

The SWT may be connected between a DL (DLi) and the second node N2 of the DRT, and turned on in such a manner that a scan signal (SCAN) is applied to the gate node of the SWT. The SWT is turned on by the scan signal (SCAN) to transfer the data voltage (Vdata) supplied from the DL (DLi) to the second node N2 of the DRT.

The SENT may be connected between the first node N1 of the DRT and a Reference Voltage Line (RVL) for supplying a reference voltage (VREF), and turned on in such a manner that a sensing signal (SENSE) which is a kind of the scan signal is applied to the gate node of the SENT. The SENT is turned on by the sensing signal (SENSE) to apply the reference voltage (VREF) supplied through the RVL to the first node N1 of the DRT. In addition, the SENT may also serve as a sensing path so that a sensing component can sense a voltage of the first node N1 of the DRT.

Meanwhile, the scan signal (SCAN) and the sensing signal (SENSE) may be respectively applied to the gate node of the SWT and the gate node of the SENT through another GL. In some cases, the scan signal (SCAN) and the sensing signal (SENSE) may be the same signal, and respectively applied to the gate node of the SWT and the gate node of the SENT through the same GL.

Referring back to FIG. 1, meanwhile, the timing controller 140 supplies various control signals to the source driver 120 and the gate driver 130 to control the source driver 120 and the gate driver 130.

The timing controller 140 starts scanning in accordance with a timing to be implemented in each frame, switches input image data input from the outside according to a data signal format used by the source driver 120, outputs the switched image data, and controls data driving at an appropriate time according to the scanning.

In order to control the source driver 120 and the gate driver 130, the timing controller 140 receives a timing signal such as a vertical synchronization signal (Vsync), a horizontal synchronization signal (Hsync), an input DE signal, or a clock signal to generate various control signals, and outputs the generated various control signals to the source driver 120 and the gate driver 130, in addition to switching the input image data input from the outside according to the data signal format used by the source driver 120 and outputting the switched image data.

For example, in order to control the gate driver 130, the timing controller 140 outputs various Gate Control Signals (GCSs) including a Gate Start Pulse (GSP), a Gate Shift Clock (GSC), a Gate Output Enable (GOE) signal, and the like.

Here, the GSP controls an operation start timing of one or more GDICs of the gate driver 130. The GSC is a clock signal commonly input to one or more GDICs, and controls a shift timing of a scan signal (gate pulse). The GOE signal designates output timing information of one or more GDICs.

In addition, in order to control the source driver 120, the timing controller 140 outputs various Data Control Signals (DCSs) including a Source Start Pulse (SSP), a Source Sampling Clock (SSC), a Source Output Enable (SOE) signal, and the like.

Here, the SSP controls a data sampling start timing of one or more SDICs of the source driver 120. The SSC is a clock signal that controls a sampling timing of data in each of the SDICs. The SOE signal controls an output timing of one or more SDICs of the source driver 120.

Figure 3:
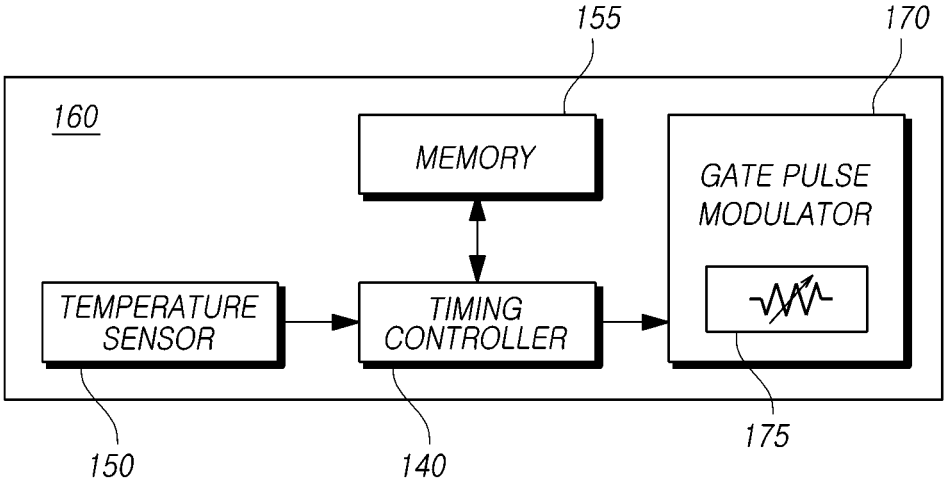
FIG. 3 is a block diagram of a control printed circuit board according to embodiments of the present disclosure.

Referring to FIGS. 1-3 together, meanwhile, the timing controller 140 according to the present embodiment may be mounted on a control printed circuit board 160, and modulate the scan signal according to a temperature of the display panel 110 together with a temperature sensor 150 for detecting a temperature of the display panel 110, a gate pulse modulator 170 for modulating a scan signal, and a memory 155 for storing modulation information of the scan signal according to the temperature, e.g., all mounted on the control printed circuit board 160, as shown in FIG. 3.

The temperature sensor 150 is mounted on the control printed circuit board 160 to detect the temperature of the display panel 110, and detects the temperature of the display panel 110, which is generated when power is applied to the display panel 110 and an image is displayed. Meanwhile, the temperature of the display panel 110 is also increased when a temperature outside of the organic light emitting display device 100 is increased, and thus the temperature detected by the temperature sensor 150 reflects not only the temperature generated by the operation of the display panel 110 but also the ambient temperature. Information on the temperature detected by the temperature sensor 150 may be provided to the timing controller 140.

Figure 4:
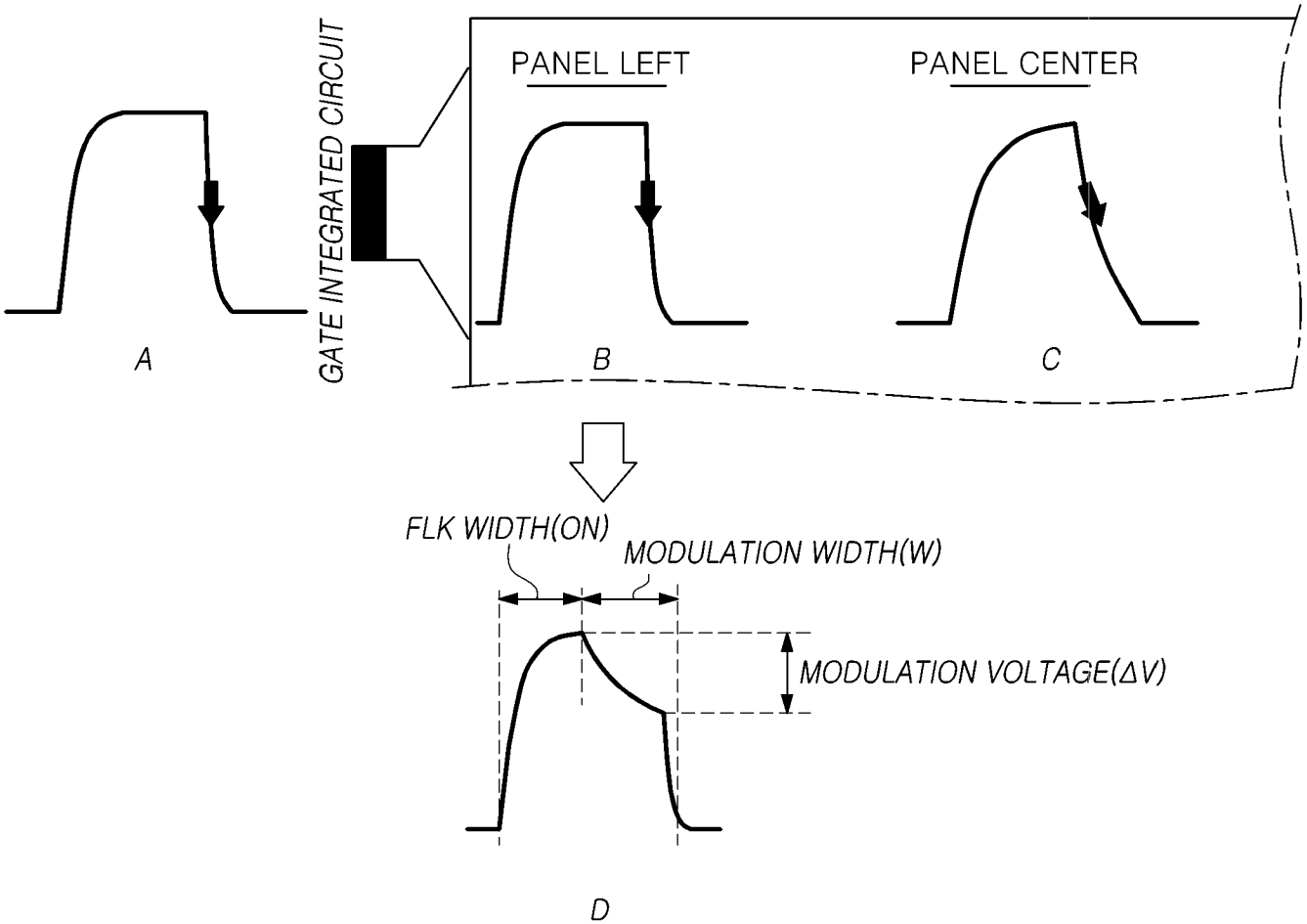
FIG. 4 is a conceptual diagram illustrating a concept of modulation of a scan signal.
Figure 5:
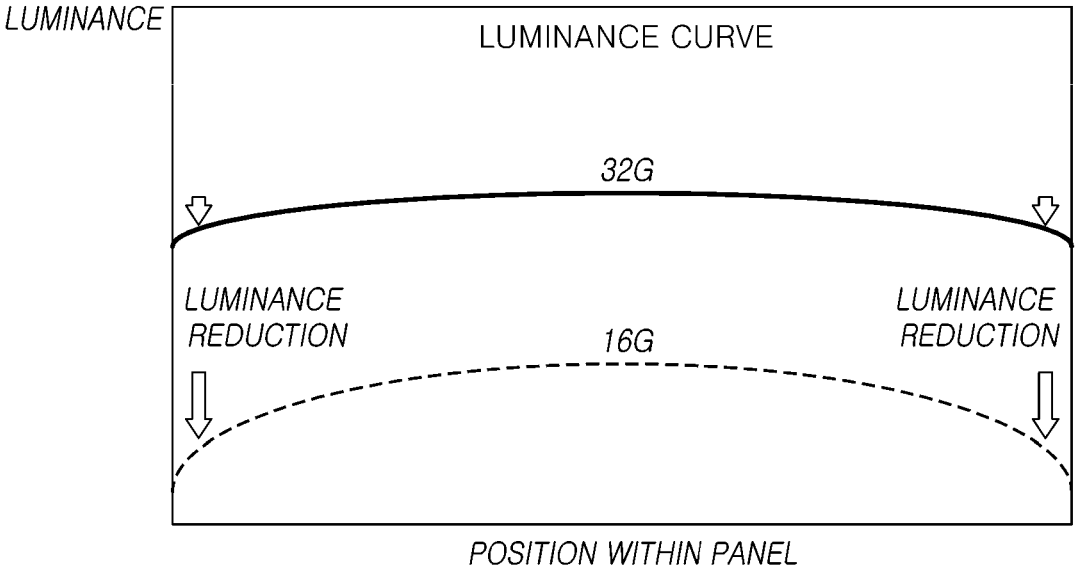
FIG. 5 is a diagram illustrating a luminance curve of a display panel.

The gate pulse modulator 170 may modulate the scan signal supplied to the SWT of each SP through the gate driver 130. As shown in FIG. 4, when a square-waved scan signal having a waveform A is input to the gate driver 130, a voltage variation due to a parasitic capacitor of the SWT, that is, a kickback is increased and a delay of the scan signal is reduced at both end regions (i.e., the two opposite sides) of the display panel 110, and thus a waveform B having substantially the same size and shape as the waveform A of the input scan signal is maintained for SPs at end regions of the display panel 110. However, as a voltage lost due to an RC structure increases toward the central region of the display panel 110, that is, as a load increases, the delay of the scan signal becomes larger and the kickback becomes smaller, and thus the corresponding waveform changes to a waveform C and a current flowing in the SWT becomes smaller. As a result, as shown in FIG. 5, a phenomenon in which a luminance is lowered at both ends of the display panel 110 occurs. In order to prevent this, the gate pulse modulator 170 modulates a scan signal waveform at both end regions of the display panel 110 such that the current flowing in the SWTs at both end regions and central region of the display panel 110 are made equal.

When a voltage for starting the scan signal is referred to as a scan voltage and a voltage applied to a falling section of the scan signal to correct and lower the voltage of the scan signal is referred to as a correction voltage, the gate pulse modulator 170 may modulate the correction voltage in the scan signal of both end regions. When the correction voltage is adjusted, the gate pulse modulator 170 may reduce the voltage of the scan signal by adjusting a timing at which the correction voltage is started and the magnitude of the correction voltage. Here, a width from a point where the application of the correction voltage is started to a point where the scan signal is turned off is referred to as a modulation width W, and a voltage change from the unmodulated voltage level of the scan signal, e.g., at the point the correction voltage is started to be applied, to a point where the correction voltage is removed/reduced is referred to as a modulation voltage $\Delta V$.

Figure 6A:
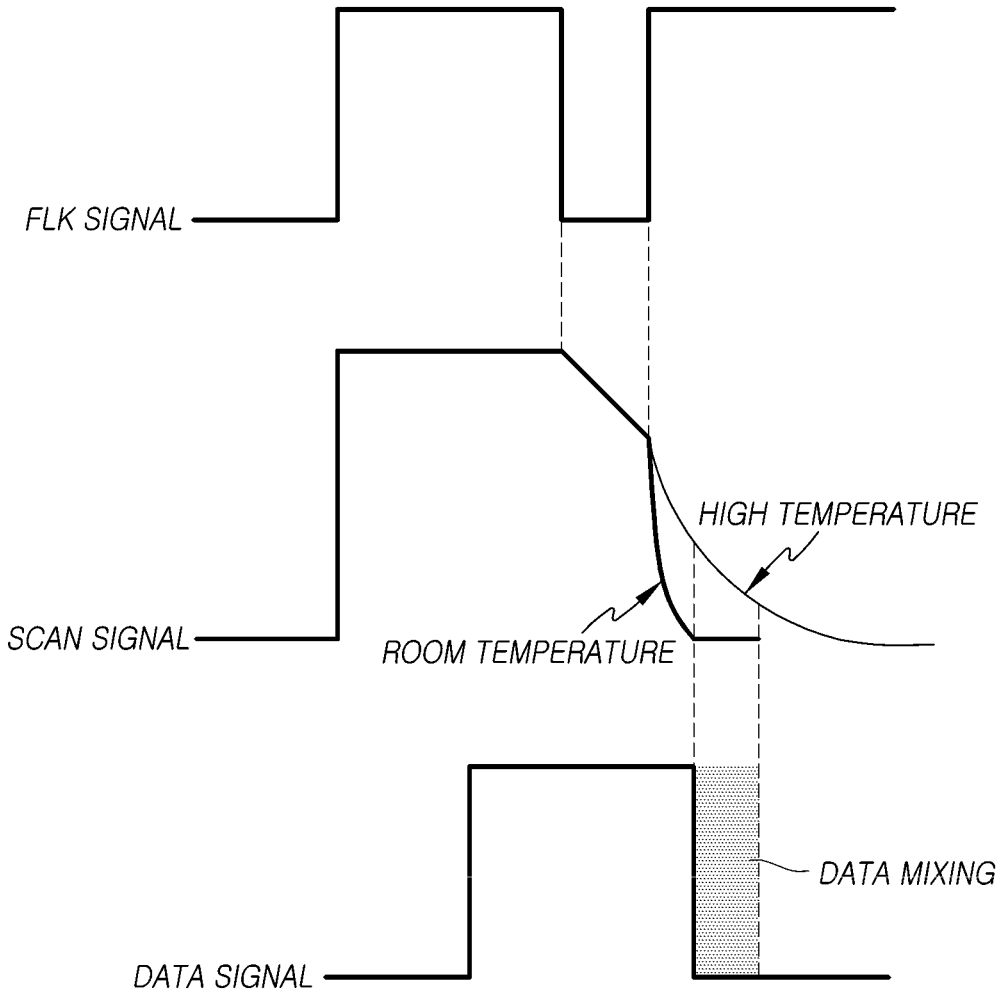
FIG. 6A is a graph showing a phenomenon in which a fall time of a scan signal is increased at a high temperature is increased.

In addition, the gate pulse modulator 170 may modulate the scan signal by adjusting the correction voltage in accordance with the temperature of the display panel 110 detected by the temperature sensor 150. When the display panel 110 is heated to a high temperature, the fall time of the scan signal is increased and a data signal becomes longer due to the increased fall time of the scan signal, as shown in FIG. 6A. Accordingly, not only data applied to the corresponding DL but also a part of data to be applied to the next DL are applied together, so that there is a problem in that the data is mixed with one another. Thus, in order to reduce the fall time of the scan signal at a high temperature, the gate pulse modulator 170 according to the present embodiment may adjust the modulation width and the modulation voltage of the correction voltage in real time according to the temperature detected by the temperature sensor 150.

Figure 6B:
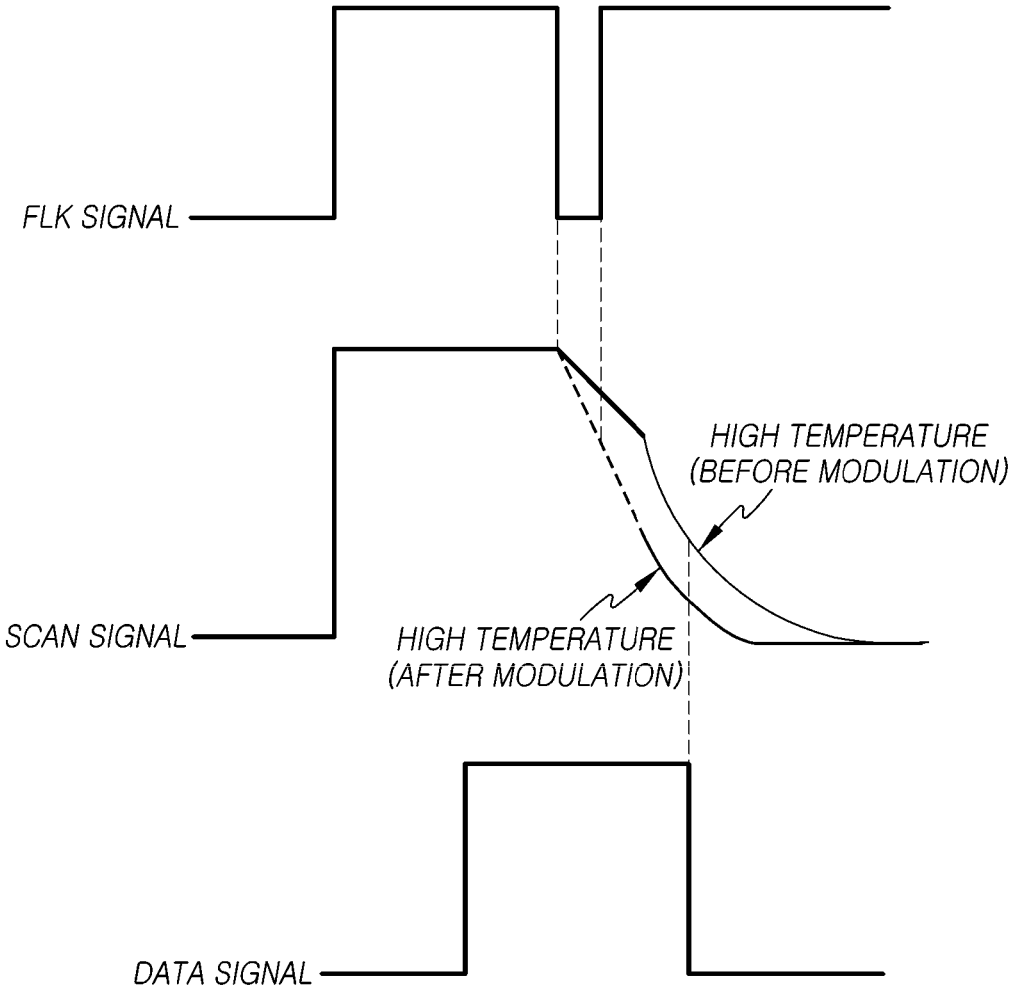
FIG. 6B is a graph showing a scan signal in which an increase of a fall time is prevented according to an embodiment of the present disclosure.

As shown in FIG. 6B, when the modulation voltage of the correction voltage is increased while the modulation width of the correction voltage is maintained, the scan signal may be rapidly turned off even at a high temperature, so that the fall time may be rapidly reduced. Accordingly, since the data signal interlocked with the scan signal has a normal shape and width, it is possible to prevent the occurrence of the phenomenon in which the data is mixed with one another as the data signal becomes longer. When the data is prevented from being mixed with each other in this manner, lattice-like stains may be prevented, thereby improving the image quality of the display panel 110.

Such a gate pulse modulator 170 may adjust the modulation width and the modulation voltage of the correction voltage according to the temperature of the display panel 110. Here, the higher the temperature, the greater the variation of the modulation voltage and the modulation width of the correction voltage. Accordingly, it is possible to prevent the fall time of the scan signal from being extended at a high temperature.

To this end, the gate pulse modulator 170 includes a variable resistor 175. The gate pulse modulator 170 may linearly modulate the correction voltage by the variable resistor 175. The gate pulse modulator 170 has a variable resistance value for the correction voltage. When receiving a value for the correction voltage from the timing controller 140, the gate pulse modulator 170 may adjust the variable resistor 175 so that a scan signal having a modulation width and a modulation voltage corresponding to the received correction voltage may be output. By using the variable resistor 175 in this manner, the modulation width and the modulation voltage may be linearly controlled in real time.

Meanwhile, information on the relationship between the temperature of the display panel 110 and the correction voltage is stored in the memory 155. The memory 155 stores a temperature-correction voltage table in which the temperature of the display panel 110 is divided into sections each having a predetermined width and the modulation width and the modulation voltage of the correction voltage are matched for each of the sections.

Such a temperature-correction voltage table is configured for each SP along a GL. Since the waveforms of the scan signals output to both end regions and the central region of the display panel 110 are different along the GLs, the scan signals of both end regions are modulated to compensate for the different waveforms. Accordingly, even at the same temperature, a different correction voltage must be provided to both end regions and the central region of the display panel 110. To this end, the temperature-correction voltage table may be provided for, e.g., each SP along the GLs. By setting a separate correction voltage for each SP (or each cluster of SPs) of the GL in this manner, it is possible to prevent the luminance from being lowered at both end regions of the display panel 110.

The timing controller 140 continuously receives information on the temperature of the display panel 110 from the temperature sensor 150 while the display panel 110 is operating. The timing controller 140 fetches information on the corresponding correction voltage from the temperature-correction voltage table according to the temperature supplied from the temperature sensor 150 and the position along the GL of each SP to generate an FLK (Flickering) signal, and provide the generated FLK signal to the gate pulse modulator 170.

The FLK signal is formed in the form of a pulse that repeats ON/OFF, and an OFF section of the FLK signal indicates the modulation width of the correction voltage for the scan signal for each SP. Accordingly, when the OFF section of the FLK signal becomes longer, the modulation width of the scan signal becomes larger, and when the OFF section of the FLK signal becomes shorter, the modulation width of the scan signal becomes smaller.

When receiving the FLK signal from the timing controller 140, the gate pulse modulator 170 adjusts the variable resistor 175 so that the received FLK signal is matched to the scan signal to form the modulation width of the scan signal. Then, the modulation width of the scan signal may be adjusted by the variable resistor 175 to be proportional to the FLK signal. Accordingly, each SP has a uniform luminance in each region of the display panel 110 along the GL and prevents a delay of the fall time at a high temperature, thereby improving the image quality.

Figure 7:
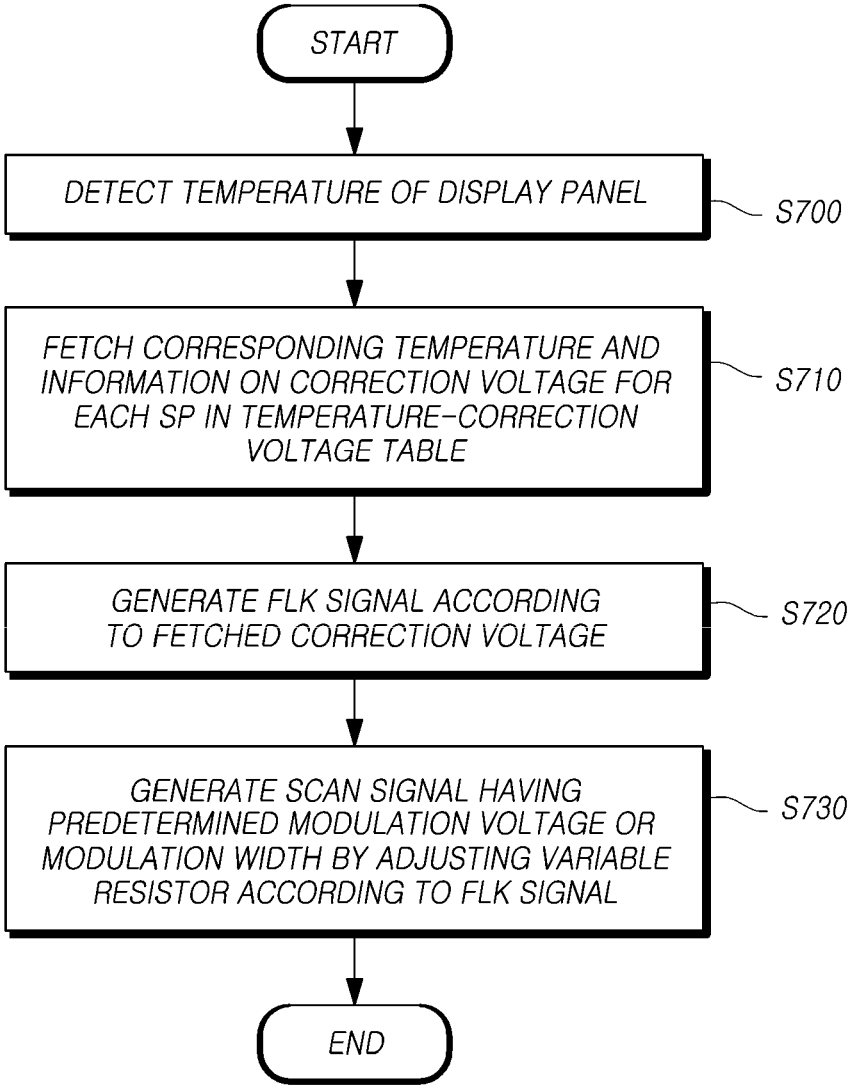
FIG. 7 is a flowchart illustrating a process of modulating a scan signal of an organic light emitting display device according to an embodiment of the present disclosure.

Referring to FIG. 7, a process of modulating a scan signal according to a temperature change of the display panel 110 in an organic light emitting display device having the above-described configuration will be described as follows.

When the organic light emitting display device operates to display an image on the display panel 110, the temperature sensor 150 detects a temperature of the display panel 110 in operation S700, and outputs the detected result to the timing controller 140. In operation S710, the timing controller 140 matches information on the temperature provided from the temperature sensor 150 to a temperature-correction voltage table stored in the memory 155, and fetches a correction voltage for one or more SP for the corresponding temperature. At this time, in operation S720, the timing controller 140 may generate an FLK signal by fetching the correction voltage for each SP of the GL(s), e.g., the current GL. In operation S730, the FLK signal is supplied to the gate pulse modulator 170, and the gate pulse modulator 170 generates a scan signal having the same modulation width as a width corresponding to an OFF section of the FLK signal using the variable resistor 175. At this time, the modulation width and the modulation voltage increase as the detected temperature of the display panel 110 increases, and a scan signal is generated such that the modulation width and the modulation voltage increase toward both ends of the display panel 110. It should be appreciated that it is possible that for some SPs in the GL, the modulation width and/or the modulation voltage may equal to zero in some scenarios, which is included in the disclosure.

As described above, according to the present embodiment, it is possible to prevent the fall time of the scan signal from being delayed (or from being unevenly delayed among SPs) by variably modulating the correction voltage of the scan signal according to the temperature of the display panel 110. When the delay of the fall time is prevented in this manner, data may be prevented from being mixed with each other, so that it is possible to realize a clearer image, thereby improving the image quality.

The features, structures, effects, and the like described in the above embodiments are included in at least one embodiment and but are not limited to one embodiment. In addition, the features, structures, effects, and the like described in the respective embodiments may be executed by those skilled in the art while being combined or modified with respect to other embodiments. Accordingly, it will be understood that contents related the combination and modification will be included in the scope of the present disclosure.

Further, it should be understood that the embodiments described above should be considered in a descriptive sense only and not for purposes of limitation. It will be understood by those skilled in the art that various other modifications and applications may be made therein without departing from the spirit and scope of the embodiments. For example, respective components shown in detail in the embodiments may be executed while being modified. The scope of the present disclosure should be interpreted by claims attached thereto, and it should be interpreted that all technical spirits within the scope equivalent to the claims pertains to the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device, comprising:

a display panel in which a plurality of sub pixels adjacently arranged to a plurality of data lines and a plurality of gate lines;

a temperature sensor configured to detect a temperature information of the display panel;

a gate pulse modulator configured to modulate a voltage of a scan signal in a falling section of the scan signal provided to the plurality of gate lines, in accordance with the temperature information; and a timing controller configured to receive the temperature information detected by the temperature sensor, and provide control on a correction voltage of the scan signal determined based on the temperature information to the gate pulse modulator;

wherein the scan signal is modulated by a first voltage difference value at a first temperature of the display panel for a modulation width of the scan signal and the scan signal is modulated by a second voltage difference value at a second temperature of the display panel for the modulation width of the scan signal, wherein the correction voltage is controlled to have a first voltage value when the display panel is at a first temperature and a second voltage value when the display panel is at a second temperature, and the first temperature is higher than the second temperature, and wherein the first voltage difference value between a voltage value at a non-falling section of the scan signal and the first voltage value is greater than the second voltage difference value between the voltage value at the non-falling section of the scan signal and the second voltage value.

2. The organic light emitting display device according to claim 1, wherein the gate pulse modulator includes a variable resistor for adjusting at least one of a modulation width or a modulation slope in the falling section of the scan signal in substantially real time based on the correction voltage, wherein the modulation slope is based on a voltage difference value and the modulation width, the voltage difference value including the first voltage difference value and the second voltage difference value.

3. The organic light emitting display device according to claim 2, wherein the timing controller is configured to determine the correction voltage that is associated with at least one of an increased modulation width or an increased modulation slope in the falling section of the scan signal in a case that the temperature of the display panel increases.

4. The organic light emitting display device according to claim 1, wherein the timing controller is configured to determine a first correction voltage with a first modulation width and a first modulation voltage for a first sub pixel located toward a side end of the display panel and a second correction voltage with a second modulation width and a second modulation voltage for a second sub pixel located toward a center of the display panel, at least one of the first modulation width or the first modulation voltage being larger than the respective second modulation width or second modulation voltage.

5. The device of claim 1, wherein the temperature information includes a temperature generated during operation of the display panel and an ambient temperature associated with the display panel.

6. A control method of an organic light emitting display device including a display panel in which a plurality of sub pixels defined by a plurality of data lines and a plurality of gate lines are arranged, the control method comprising:

detecting a temperature of the display panel;

providing a correction voltage based on the temperature, the correction voltage being controlled to have a first voltage value when the display panel is at a first temperature and a second voltage value when the display panel is at a second temperature, and the first temperature is higher than the second temperature; and modulating a voltage in a falling section of a scan signal provided to one or more of the plurality of gate lines, in substantially real time based on the correction voltage, the modulating including:

modulating the voltage such that at least one of a modulation width or a modulation voltage applied to the falling section of the scan signal increases as the temperature of the display panel increases;

wherein after the modulating, a width of the scan signal when the display panel is at the first temperature is narrower than a width of the scan signal when the display panel is at the second temperature.

7. The control method according to claim 6, wherein the modulating includes applying at least one of a larger modulation width or a larger modulation voltage for a first sub pixel located toward an end region of the display panel as compared to a second sub pixel located toward a center of the display panel along the gate lines of the display panel.

8. A method of controlling a gate signal applied to a gate of a transistor in a pixel circuit of an organic light emitting display panel, comprising:

determining a temperature of the display panel, the temperature including a first temperature and a second temperature that is higher than the first temperature;

determining a location of the pixel circuit with regard to the display panel; and adjusting a falling edge of the gate signal during a modulation width, the adjusting including:

modulating the falling edge of the gate signal to have a first slope during the modulation width based on the first temperature and the location of the pixel circuit; and modulating the falling edge of the gate signal to have a second slope during the modulation width based on the second temperature and the location of the pixel circuit, the second slope being steeper than the first slope.

9. The method of claim 8, wherein the adjusting includes:

providing a variable resistor; and applying a correction voltage to the gate signal through the variable resistor, the correction voltage being determined based on at least one of the temperature or the location of the pixel circuit.

10. A method, comprising:

determining a temperature of a display panel having multiple sub pixels;

comparing the determined temperature with on a table that correlates the temperature and a correction voltage for each of the multiple sub pixels of the display panel;

determining the correction voltage for one of multiple sub pixels of the display panel, the correction voltage being controlled to have a first voltage value when the display panel is at a first temperature and a second voltage value when the display panel is at a second temperature, and the first temperature is higher than the second temperature;

generating a flickering signal based on the correction voltage of the one of the multiple sub pixels; and modulating a scan signal for the one of the multiple sub pixels based on the flickering signal, the modulating including:

changing the scan signal to have a first slope during a width of the scan signal when the display panel is at the first temperature; and changing the scan signal to a second slope during the width of the scan signal when the display panel is at the second temperature, wherein the first slope is greater than the second slope, the first slope being based on the first voltage value and the width of the scan signal and the second slope being based on the second voltage value and the width of the scan signal.

11. The method of claim 10, wherein the modulating the scan signal includes adjusting a variable resistor based on the flickering signal.

12. The method of claim 10, wherein the modulating the scan signal includes modulating the scan signal with the modulation width corresponding to a width of an off section of the flickering signal.

13. The method of claim 10, wherein the modulating the scan signal includes modulating a first scan signal with a first modulation width and a first modulation voltage for a first sub pixel arranged in a first location in a gate line and modulating a second scan signal with a second modulation width and a second modulation voltage for a second sub pixel arranged in a second location in the gate line, the second location being closer to a center of the display panel than the first location, and wherein at least one of the first modulation width or the first modulation voltage is larger than the second modulation width or the second modulation voltage, respectively.

14. The method of claim 10, wherein the modulating the scan signal include modulating the scan signal with a first modulation width and a first modulation voltage based on a first temperature and modulating the scan signal with a second modulation width and a second modulation voltage based on a second temperature, the first temperature being higher than the second temperature, and wherein at least one of the first modulation width or the first modulation voltage is larger than the second modulation width or the second modulation voltage, respectively.

15. The method of claim 10, wherein the determining the correction voltage is conducted through a timing controller associated with the display panel.

16. The method of claim 10, wherein the modulating the scan signal includes applying the correction voltage to the scan signal.

17. The method of claim 16, wherein the modulating the scan signal is conducted through a gate pulse modulator associated with the display panel.

* * * * *